US010533381B2

(12) United States Patent
Head et al.

(10) Patent No.: US 10,533,381 B2
(45) Date of Patent: Jan. 14, 2020

(54) WET CONNECTION SYSTEM FOR DOWNHOLE EQUIPMENT

(71) Applicant: Coreteq Systems Limited, Bagshot, Surrey (GB)

(72) Inventors: Philip Head, Virginia Water (GB); Hassan Mansir, Maidenhead Birkshire (GB)

(73) Assignee: Coreteq Systems Limited, Surrey (GB)

( * ) Notice: Subject to any disclaimer, the term of this patent is extended or adjusted under 35 U.S.C. 154(b) by 117 days.

(21) Appl. No.: 15/695,174

(22) Filed: Sep. 5, 2017

(65) Prior Publication Data

US 2018/0066479 A1 Mar. 8, 2018

(30) Foreign Application Priority Data

Sep. 5, 2016 (GB) ..... 1615039.3

(51) Int. Cl.
*E21B 17/02* (2006.01)
*E21B 33/03* (2006.01)
*E21B 43/12* (2006.01)

(52) U.S. Cl.
CPC ..... *E21B 17/028* (2013.01); *E21B 33/03* (2013.01); *E21B 43/128* (2013.01)

(58) Field of Classification Search
CPC . E21B 17/028; E21B 33/0385; E21B 33/0407
See application file for complete search history.

(56) References Cited

U.S. PATENT DOCUMENTS 5,435,395 A * 7/1995 Connell ..... E21B 17/025 166/384
6,065,540 A * 5/2000 Thomeer ..... E21B 17/06 138/125
6,799,633 B2 * 10/2004 McGregor ..... B23K 3/0623 166/250.01
7,541,543 B2 6/2009 Head
7,708,078 B2 * 5/2010 Stoesz ..... E21B 17/023 166/376
9,458,705 B2 * 10/2016 Semple ..... E21B 43/128
9,988,894 B1 * 6/2018 Malone ..... E21B 47/024
2003/0085815 A1 5/2003 Tilton et al.
2006/0086508 A1 * 4/2006 Coon ..... E21B 23/08 166/380
2012/0222853 A1 * 9/2012 Head ..... E21B 17/028 166/65.1
2013/0062050 A1 * 3/2013 Head ..... E21B 17/028 166/105

(Continued)

*Primary Examiner* — Shane Bomar
(74) *Attorney, Agent, or Firm* — Fay Sharpe LLP

(57) ABSTRACT

A wet connection system suitable for use in hydrocarbon wells is formed from one or more elongated, small diameter conduits which extend down the wellbore and which terminate adjacent a locating structure on the production tubing. Equipment deployed at the locating structure is connected to one or more self supporting conductors which extend down the conduits from the wellhead. Preferably the conductors are retractable and the conduits are sealingly connected to the equipment, allowing the equipment and conductors to be deployed and recovered independently of each other and to be flushed with dielectric oil pumped down the conduits after re-connection.

18 Claims, 3 Drawing Sheets

(56) References Cited

U.S. PATENT DOCUMENTS

| | | | | |
|---|---|---|---|---|
| 2014/0030904 | A1* | 1/2014 | Head | H01R 13/00 439/283 |
| 2014/0370735 | A1* | 12/2014 | Nicholson | H01R 13/523 439/271 |
| 2017/0247954 | A1* | 8/2017 | Bencze | E21B 33/0385 |

* cited by examiner

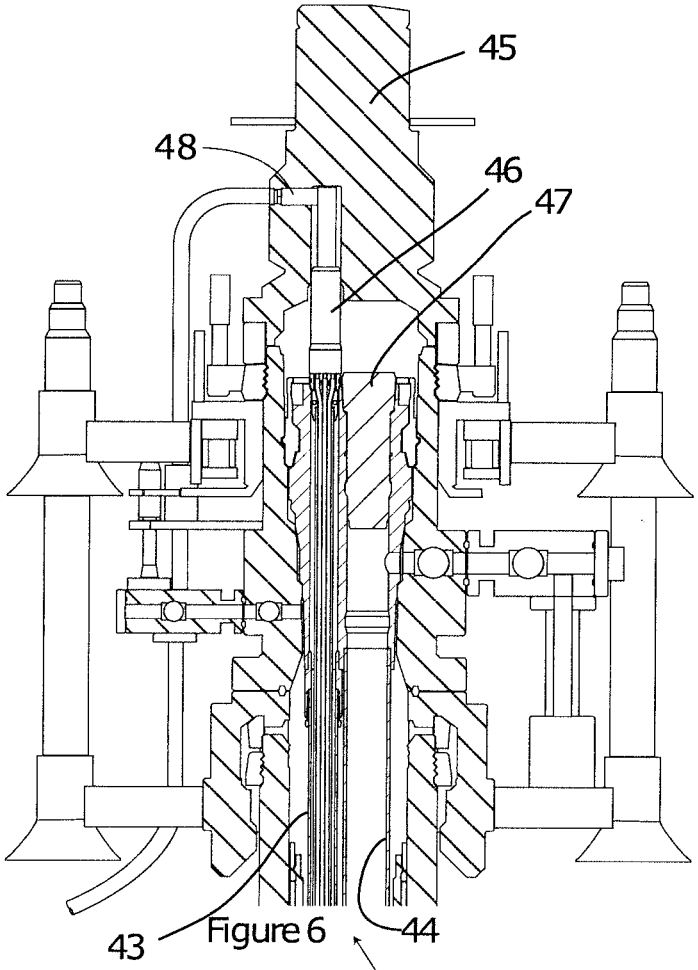
Figure 6
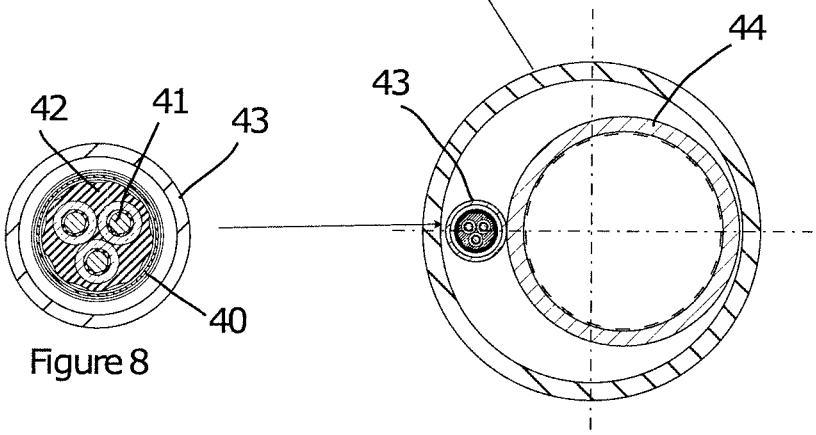
Figure 8
Figure 7

WET CONNECTION SYSTEM FOR DOWNHOLE EQUIPMENT

CROSS-REFERENCE TO RELATED APPLICATIONS

This application claims priority to and the benefit of Great Britain Patent Application No. GB1615039.3, filed Sep. 5, 2016, the entirety of which is hereby incorporated by reference as if fully set forth herein.

This invention relates to wet connection systems for connecting a conductor or conductors to equipment deployed in a borehole, for example, an oil or gas well. Wet connection systems provide a connection that can be made and unmade in-situ in a liquid environment so that the deployed equipment can be disconnected and recovered without removing the conductor from the borehole, and then re-connected to the conductor in situ when the equipment is re-deployed.

Commonly, the or each conductor is an electrical conductor, which may be used for example to provide a data connection or to supply power to an electric submersible pump assembly (ESP).

Usually, an oil or gas well will be lined with tubing that is cemented into the borehole to form a permanent well casing, the inner surface of the tubing defining the wellbore. The fluid produced from the well is ducted to the surface via production tubing which is usually deployed down the wellbore in jointed sections and (since its deployment is time consuming and expensive) is preferably left in situ for the productive life of the well. Where an ESP is used to pump the well fluid to the surface, it may be permanently mounted at the lower end of the production tubing, but is more preferably deployed by lowering it down inside the production tubing on a wireline or on continuous coiled tubing, so that it can be recovered without disturbing the production tubing.

It is known for example from US 2003/0085815 A1 to provide a well casing with a docking station which is connected to the surface by conductors. The docking station and conductors are deployed together with the casing and permanently cemented into the borehole together with the casing. Tools deployed down the well may be releasably connected to the conductors via the docking station.

WO2005003506 to the present applicant discloses a wet connection system in which one or more conductors are arranged in the annular gap between a string of production tubing and a well casing and terminate at a connection structure fixed to the lower end of the production tubing. An ESP is lowered down the production tubing and connected with the conductors by an arm which moves radially outwardly to engage the connection structure.

In practice, the last mentioned system may be used to deploy an ESP or other equipment by remote control in an oil or gas well by connecting it to a connection structure on the production tubing at a depth of several kilometers in an aggressive environment in which it is subjected to high pressures and temperatures, heavy mechanical loading, vibration, corrosive fluids, dissolved gases which penetrate electrical insulation and particulates which can clog mechanical parts. Since the wet connection between the deployed equipment and the conductors is made and unmade in this environment, failure often occurs in the region of the wet connector assembly and, less frequently, in the conductors which connect it to the surface, and, where the conductors are electrical power conductors, most frequently in the insulation of the electrical conductors close to the point of connection. By unmaking the wet connection and recovering the deployed equipment to the surface, damaged connectors on the deployed equipment can be identified and repaired. However, damaged connectors at the lower end of the conductors can only be inspected and replaced by recovering the entire string of production tubing, which is laborious and expensive.

It is an object of the present invention to provide a method and apparatus for making a wet connection to downhole equipment, which addresses this problem.

According to the present invention there is provided a method of installing and retrieving and annular mounted conductor and its respective electrical wet connector.

According to a further aspect of this invention the electrical conductor is capable of supporting its own weight.

According to a further aspect of this invention the electrical conductor is conveyed through a continuous tube mounted to the side of the production tubing.

According to a further aspect of this invention the electrical conductor is conveyed as a single conductor.

According to a further aspect of this invention the electrical conductor is conveyed as a three phase assembly.

According to a further aspect of this invention the electrical submersible pump is lowered and retrieved using slickline, wireline or coiled tubing inside the production tubing together with the other half of the electrical wet connector.

According to a further aspect of this invention the electrical conductor is removed through hydraulic pressure controlled equipment.

According to a further aspect of this invention the electrical conductor is flushed using flurinert (3M dielectric product with 2.0 specific gravity) or similar dielectric fluid.

According to a further aspect of the present invention, the wet connection system suitable for use in hydrocarbon wells preferably comprises one or more elongate, small diameter conduits which extend down the wellbore and terminate adjacent a locating structure on the production tubing. Equipment deployed at the locating structure is connected to one or more self supporting conductors which extend down the conduits from the wellhead. Preferably the conductors are retractable and the conduits are sealed and connected to the equipment, allowing the equipment and conductors to be deployed and recovered independently of each other and to be flushed with dielectric fluid pumped down the conduits after re-connection.

In accordance with the various aspects of the present invention there are provided a system and a method as defined in the claims.

Some illustrative embodiments of the invention will now be described, purely by way of example and without limitation to the scope of the claims, and with reference to the accompanying drawings, in which:

FIG. 6 is a side cross section of a subsea horizontal Christmas tree with an annular mounted power cable passing through the tubing hanger and connected to an electrical wet connector mounted in the tree cap.

FIG. 7 is an end cross section of the production casing, production tubing and annular mounted power cable.

FIG. 8 is a close-up section end view of the power cable mounted inside the annularly mounted coiled tubing.

Figure 1:
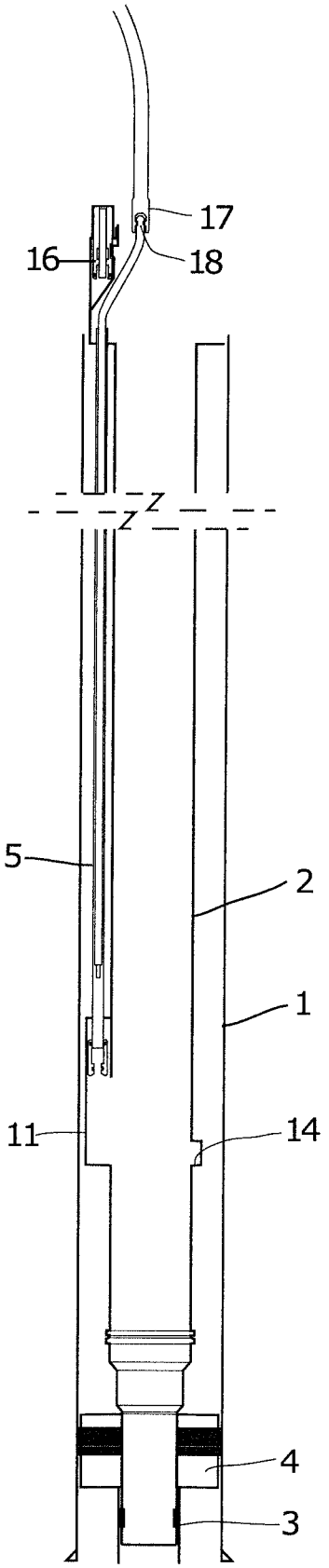
FIG. 1 is a longitudinal section through a borehole in accordance with an annular conductor mounted to production tubing and its lower end terminated into the upper side of a structure in the production tubing.
Figure 2:
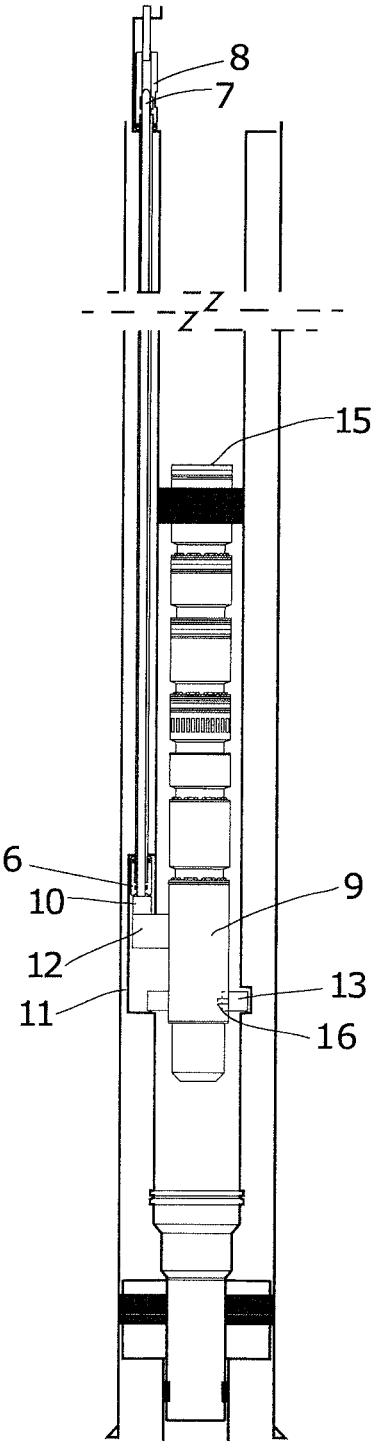
FIG. 2 is a similar view to FIG. 1 with an ESP installed inside the production tubing and docked into the wet connector located in the structure in the production tubing.

Referring to FIGS. 1 and 2, there is shown a well with casing 1 inside which is set production tubing 2 stung into a polished bore receptacle 3 of a packer 4. On the outside of the tubing are three tubes 5 though which a conductor 6, which is terminated at the production tubing hanger 7 and connects to the outside world via an electrical wet connector 8. At its lower end it connects into a powered device such as an electrical submersible pump (ESP) 9 via a downhole electrical wet connector 10. The through tubing retrievable ESP is lowered past the structure in the production tubing 11, it is then picked up and orientates its plug arm 12 into the annularly positioned electrical connector using proximity sensors or other means. At an overpull of 200 lbs the wet connector is fully engaged, and during the engagement process the electrical parts are flushed with flurinert or equivalent dielectric fluid. At the same time during the overpull, frangible anchors 13 are deployed which locate in the profile 14.

The plug arm is extends radially from the ESP, and once the plug arm is beneath the lower edge of the tubing, there is enough room between the sides of the ESP and the tubing for the plug arm to be maneuvered outside of the tubing wall by displacing the ESP from the tubings centre axis for the plug arm to be oriented beneath the electrical connector.

In the event that there is a fault with the ESP motor on the half of the wet connector attached to the motor, a GS running tool is lowered into the well and locates in an internal profile at the pump discharge 15. A downward jar is activated which shear pins in the frangible anchors 13. The GS running tool is then picked up with an over pull of 300 lbs. This releases the anchors and the whole assembly can then be lowered, undocking it from the wet connector and enabling the assembly to be retrieved back to surface for repair or service or replacement.

In the event that there is a fault with the conductor in the annulus or wet connector at its lower most end, the surface wet connector 8 is disengaged from an electrical bulkhead 16 and a retrieval tool 17 is lowered into the Christmas tree through pressure control equipment not shown and attaches itself to the cable head 18 and removes the conductor, for repair service or replacement.

Figure 3:
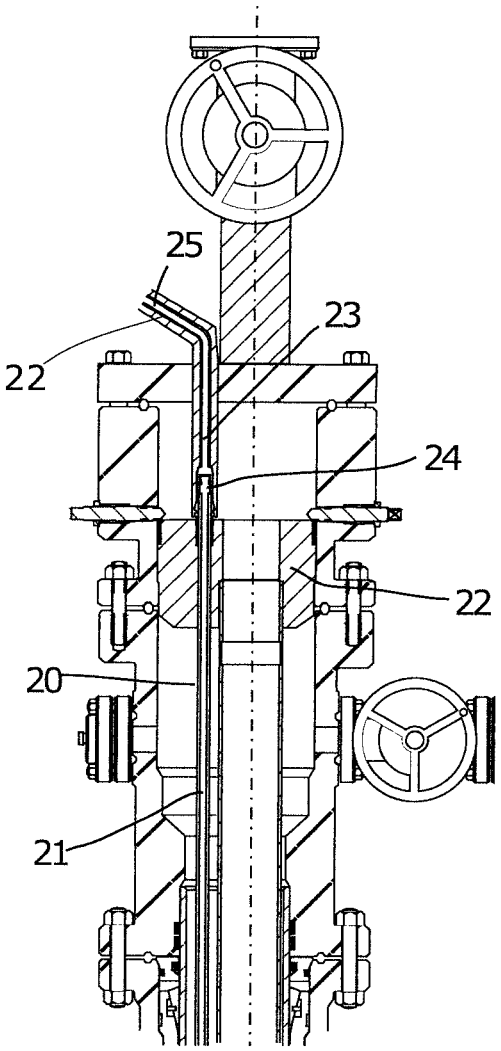
FIG. 3 is a section side view of a well head showing one of the annular conductors penetrating the tubing hanger and an upper wet connector attached to the annular conductor.
Figure 4:
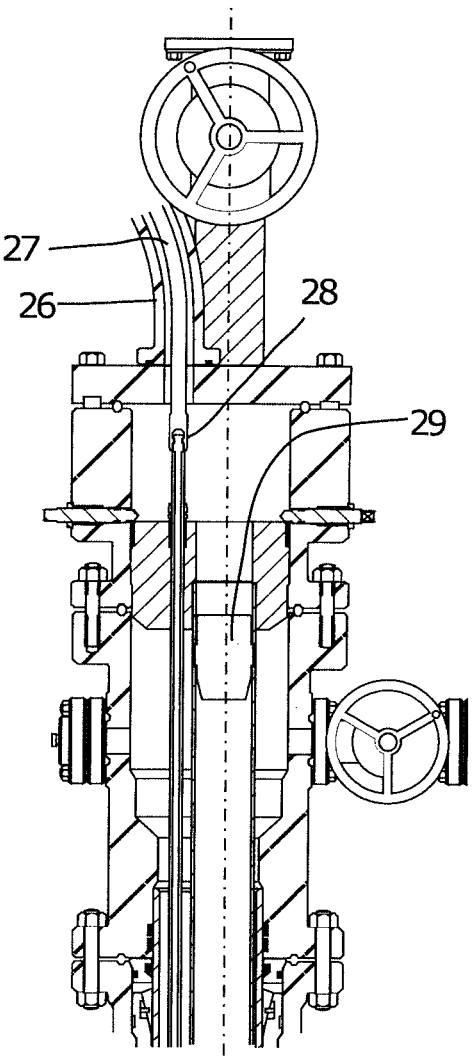
FIG. 4 is a similar view to FIG. 3 with the annular conductor being retrieved through pressure control equipment.
Figure 5:
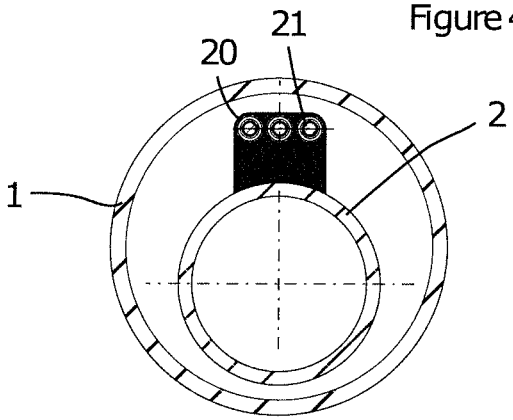
FIG. 5 is an end cross section of the production casing, production tubing and annular mounted power cable.

FIGS. 3 to 5 show a surface arrangement for a typical land Christmas tree, the conductors 20 are mounted into individual tubes 21 which pass through the tubing hanger and enable the surface wet connector 23 to engage with the upper half of the conductor protruding above the hanger 24. The surface wet connector includes flow area 22 around the conductor 25 to enable a dielectric fluid to be pumped into around the electrical wet connector. In the event the conductor has to be removed, pressure control equipment 26 is installed and a retrieval tool lowered 27 into it to fish the conductor 28. A plug 29 may or may not be used to isolate the production tubing during this operation.

FIGS. 6 to 8 show a typical subsea horizontal tree arrangement. The annular cable could be, for example, a section of coiled tubing as described in more detail in patent number U.S. Pat. No. 7,541,543 (though other suitable cables may be used). Such a cable can support its own weight and has a metal external layer 40, with three electrical conductors 41 twisted together and held in a jacket 42. This cable is located inside a section of coiled tubing 43 which is attached to the outside surface of the production tubing 44. During service the tree cap 45 is removed, and the wet connector 46 is removed with it. Pressure control equipment is then installed. Full access to the top of the tubing hanger 47 is now possible. It is possible to access either the externally run power cable or the internally run ESP.

The invention claimed is:

1. A system for connecting a conductor to equipment deployed down a borehole, including tubing extending down the borehole from an upper end of the borehole;

an annularly positioned electrical connector disposed on the lower end of the tubing, at least one elongated conductor disposed in the annulus between the borehole and the tubing extending from the upper end of the borehole to the annularly positioned electrical connector, the conductor being connectable to the equipment in the annularly positioned electrical connector;

an electrically powered machine capable of being lowered down the tubing, the electrically powered machine including a radially spaced connector arm, such that the electrically powered machine can be oriented at the bottom end of the tubing so that it coincides with the annularly positioned electrical connector to make electrical connection to the annularly positioned electrical connector, and is secured by anchors, wherein the anchors include frangible parts that may be broken in order to release the electrically powered machine.

2. A system according to claim 1, wherein the inner surface of the tubing and the outer surface of the electrically powered machine are shaped such that the electrically powered machine is oriented as it is lowered in the tubing.

3. A system according to claim 1, wherein the electrically powered machine is raised after being lowered to make electrical connection to the annularly positioned electrical connector.

4. A system according to claim 1, wherein the elongated conductor is disposed in a conduit extending from the upper end of the borehole to the annularly positioned electrical connector.

5. A system according to claim 4, wherein the conduit is sealingly connectable to the equipment when adjacent to the annularly positioned electrical connector.

6. A system according to claim 5, wherein the conductor is connectable and disconnectable to and from the equipment when the conduit is sealingly connected to the equipment.

7. A system according to claim 4, wherein the conductor is slidably disposed inside the conduit.

8. A system according to claim 7, wherein the conductor is slidably removable from the conduit via the upper end of the borehole.

9. A system according to claim 7, wherein a lower end of the conductor is flushed with flurinert, 6.4 sp. Gr. or another dielectric fluid.

10. A system according to claim 7 wherein the upper end of the conductor is engaged with a wet connector mounted in a Christmas tree.

11. A system according to claim 7 wherein the upper end of the conductor passes through a Christmas tree to an electrical bulkhead.

12. A system according to claim 4, wherein the conductor is an electrical conductor.

13. A system according to claim 11, wherein the conductor is copper clad steel.

14. A system according to claim 4, wherein a clearance gap is filled with a protective fluid.

15. A system according to claim 4, wherein a clearance gap is sealed proximate the annularly positioned electrical connector.

16. A system according to claim 4, wherein the borehole includes a fixed casing defining a wellbore, and the tubing is deployed within the wellbore.

17. A system according to claim 16, wherein the conduit is supported by attachment to the tubing between the upper end of the borehole and the annularly positioned electrical connector.

18. A system according to claim 1, wherein the frangible parts include a frangible pin that is sheared when a jarring force is applied to the tubing.

* * * * *